United States Patent [19]

Ruehl et al.

[11] Patent Number: 4,968,264

[45] Date of Patent: Nov. 6, 1990

[54] CROSS-CONNECTING TERMINAL BLOCK ASSEMBLY

[75] Inventors: William E. Ruehl, Elgin; Richard H. Heidorn, Lombard, both of Ill.

[73] Assignee: Illinois Tool Works Inc., Chicago, Ill.

[21] Appl. No.: 410,280

[22] Filed: Sep. 21, 1989

[51] Int. Cl.[5] ..... H01R 13/66; H01R 13/68

[52] U.S. Cl. ..... 439/622; 337/229; 439/620

[58] Field of Search ..... 361/109, 106, 111, 331, 361/339, 430; 337/29, 39, 188, 190, 198, 228, 229, 248, 251, 252, 283; 439/620, 621, 622, 719

[56] References Cited

U.S. PATENT DOCUMENTS 3,854,062 12/1974 Winer ..... 337/229 X
3,882,427 5/1975 Pflanz ..... 361/111 X
4,504,883 3/1985 Uchida et al. ..... 361/119
4,547,827 10/1985 Shedd ..... 361/104 X

FOREIGN PATENT DOCUMENTS 5836 10/1913 United Kingdom ..... 337/251

*Primary Examiner*—Eugene F. Desmond
*Attorney, Agent, or Firm*—Thomas W. Buckman; Donald J. Breh; John P. O'Brien

[57] ABSTRACT

A fuse carrier operable as a surge-current protector for cross-connecting two circuits utilizes standard amperage fuses arranged in an offset alignment and secured in a housing cavity against rotational, longitudinal, and transverse movement with the fuse blades maintained in an aligned and separated position and separate by a platform with an upright protruding member, which fuses are provided in a narrow-housing configuration.

49 Claims, 1 Drawing Sheet

CROSS-CONNECTING TERMINAL BLOCK ASSEMBLY

BACKGROUND OF THE INVENTION

The present invention relates to a terminal block assembly and more specifically a current-surge protector for making cross-connections for two rows of terminals, which protector has integral fuses.

Fuse holders and fuse assemblies have been known for applications in industry, automobiles and in domestic or home environments. An assembly with a fuse receptacle integral with a dual-pronged wall plug or outlet and having a dual fuse arrangement is illustrated in U.S. Pat. No. 3,833,875 to Holoka. This dual-fuse arrangement utilizes cartridge-type fuses inserted in clips and retained within a housing. The housing has a male end coupled to the fuses at one end of the receptacle and a female receptacle end coupled to the opposite fuse end and operable to receive the mating line cord contacts. U.S. Pat. No. 4,384,282 also discloses a fused plug, which has a spare fuse retained within the plug.

Earlier cartridge-type fuse and fuse holder assemblies are exemplified by the fuse assembly illustrated in U.S. Pat. No. 1,938,097 to Curlee, which has a cartridge fuse having blade extensions matable with extending fingers to provide an in-line fuse connection or coupling. The fuse is mounted on a pivotal holder, which may be utilized to remove the fuse and open a circuit. Closing of the fuse box or support and reinserting the fuse blades into the extending fingers again closes the circuit. The fuse may be repaired or replaced in the open-circuit position. A similar fuse holder and fuse are illustrated in U.S. Pat. No. 945,017 to Cole.

Multiple fuse adapters and contacts on a single circuitboard are illustrated in U.S. Pat. No. 3,744,003 to Dipace. Similarly, a multiple element holder, which is illustrated as a printed circuit assembly, is shown in Foster U.S. Pat. No. 2,898,519, with a row of parallel components aligned on a circuitboard.

Fuses are also known as component devices in switch blocks or switching devices, which is shown in Frank U.S. Pat. No. 1,953,343; Frank U.S. Pat. No. 1,861,267; and Kinasi U.S. Pat. No. 3,872,416, where switches and fuse blocks are integrally combined for varying functions. In Frank-'267, an arrangement is provided with the fuses in a single branch unit, which may be coupled in series to provide a single branch from a double branch unit. In the Frank-'343 device, a panel board is shown with several fuse units, each having a receptacle affixed to the board and connected to a bus bar with a removable fused plug matable with this receptacle. A mounting plate, bus bars and panel board for switch blocks, fuse clips, etc., are generally equipped with the elements permanently fastened to the mounting plate. However, the Frank-'343 apparatus provided a switch block utilizing female members detachably mounted on adjacent bus bars and a male member connectable to the female members, which allowed a sectional panel board to be built on and interchanged with other panel boards.

Kinasi U.S. Pat. No. 3,872,426 disclosed a fuse holder arrangement, which is particularly used in an automobile. The fuse holder utilizes a male-female connection where the female member is a fuse box or holder. The male member is insertable in the fuse box and retains the fuses for insertion and mating with the female member. However, one of the members must be rotatable to mate with the other section to act as a contact for the contact elements of the fuses and/or fuse holder.

In DeNigris et al. U.S. Pat. No. 4,052,688, a fuse clip assembly is arranged to accept alarm-type tubular fuses and has a terminal for applying forward pressure on the fuses and for capturing an extended alarm terminal. This particular fuse clip mounting board is generally utilized with a plurality of fuses and does not provide a housing or assembly for retaining a fixed number of fuses in an alignment for rapid insertion and removal within multiple circuit lines.

All of the above apparatus provide large-assembly fuse arrangements for utilization in applications where working area or space is generally without limitation. The components in these assemblies, particularly the fuses, are relatively large and bulky and not readily adaptable to structurally constricted electronic circuits. As an example, recently promulgated specifications by testing organizations and proposed rules from standards-setting engineering groups have placed a requirement on telecommunications networks requiring fusing therein. These networks are very compact as are their components, which has driven the movement to provide compact fuse and component arrangements which must also lend themselves to ease of assembly. Therefore, in present applications where space is a critical element and miniaturized or compact assemblies are demanded, fuse apparatus are required to contribute to the space-saving trend and adapt to confined spaces while providing the same blade contact and electrical power service capability.

SUMMARY OF THE INVENTION

The present apparatus provides a fuse carrier for cross-connecting at least two circuits in a terminal arrangement and particularly provides a small, compact insulator housing for the offset mounting of at least two cartridge-type electronic components, such as fuses, diodes, resistors and capacitors, with extending blade contacts protruding from the housing for coupling or joining circuits in a circuitboard or panel arrangement. Although these components can be mounted in conventional holders, space constraints will not permit utilization of these fuse holders in limited-space terminal panels or blocks.

An insulating housing is provided with dual tubular or cylindrical-type electronic components, which are offset-mounted in the housing to accommodate the cylindrical shapes and formed end members of the components in as tight a configuration as allowable without contact between the aligned components. In a preferred embodiment, the extending blade-type contacts protruding from fuse ends are coined to offset their centerline from the fuse body centerline, which locates the fuses as close as possible to the opposed housing walls and each other while maintaining the fuse-contact blade centerline along a longitudinal axis for side-by-side mounted fuses. The contact blades extend through aligned slits in the housing end walls, which prohibit fuse rotation as well as maintaining the offset fuse centerline position. A cover plate with extending platforms at either end of the housing is mounted on the housing to encapsulate the fuses, and to nest the contact blades on either side of a platform protuberance, which maintains contact blade location and separation for insertion into a circuit or panel board. Therefore, a fused arrangement, such as in a surge-protector, for ready insertion between terminal block circuits is provided in an insulated housing with the centerlines of the contact blades extending along the same centerlines as fuses provided in an adjacent, side-by-side fuse alignment The contact blades and fuses are insertable in extant circuitboards, but are provided in a more narrow and compact package.

BRIEF DESCRIPTION OF THE DRAWINGS

In the Figures of the drawing, like reference numerals identify like components, and in the drawings.

DETAILED DESCRIPTION OF THE PREFERRED EMBODIMENT

A compact electronic component holder, operable in a terminal block and having particular application for the cross-connection of two rows of terminals, is provided in the present invention. This arrangement overcomes space limitations as well as providing an apparatus operable with the structural arrangement of extant panels or circuit assemblies, which panels have contact positions juxtaposed in a generally predetermined configuration. The component sizes utilized are consistent with present applications, thereby eliminating the necessity for altering electrical components or their capacity specification, while still reducing the volume occupied by the housing and component assembly.

The above-noted electronic component holder may find application with any of the above-noted or other electrical components utilized in electrical circuits, especially those components with a single enlarged end or a dumbbell-shaped structure. However, the invention will be particularly described with reference to a fuse structure encompassing a generally cylindrical body with enlarged endcaps and extending blade-like contacts or electrical coupling in a circuit.

Figure 1:
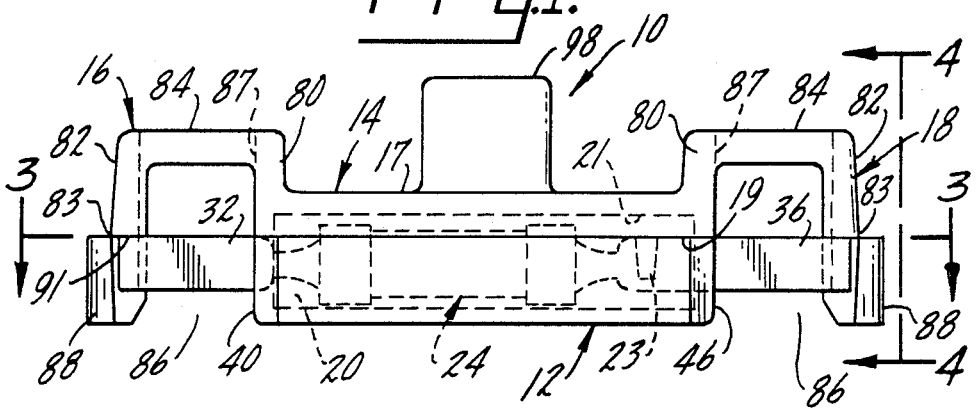
FIG. 1 is an elevational view of the fuse holder assembly.
Figure 3:
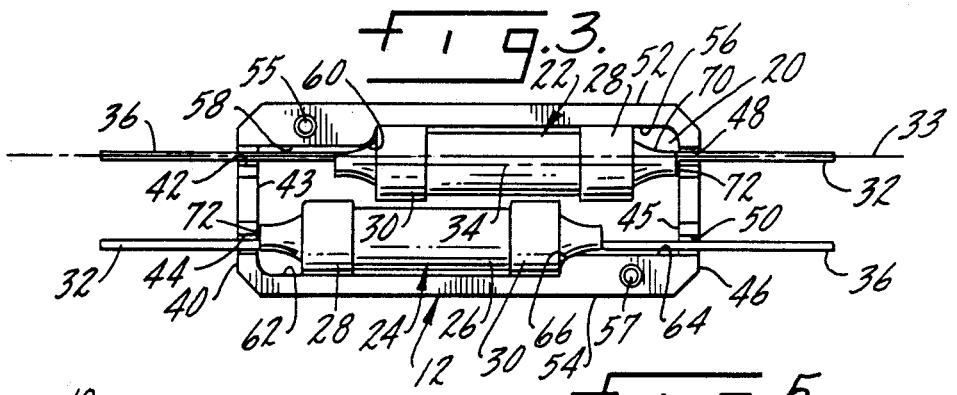
FIG. 3 is a plan view taken along the lines 3—3 of FIG. 1.

In a preferred embodiment, a fuse carrier or current-surge protector 10 is illustrated in the Figures and in FIGS. 1 and 3 are a housing 12 and a cover 14 mounted on housing 12, which cover 14 includes a first platform 16 at one end of the cover and a second platform 18 at the other end thereof. Cover 14 is positioned on housing 12 to enclose a cavity or chamber 20 in housing 12 and encase first and second fuses 22 and 24 therein.

Figure 5:
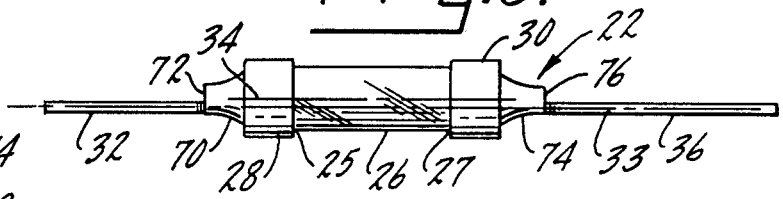
FIG. 5 is a plan view of a fuse in FIG. 3.
Figure 6:
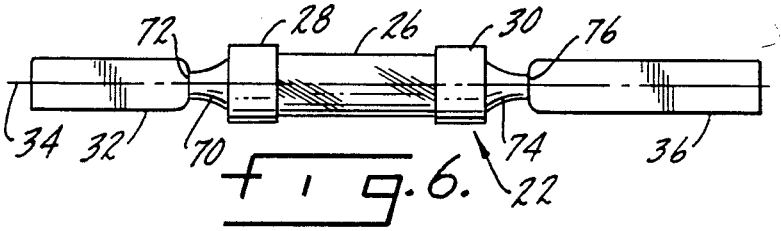
FIG. 6 is an elevational view of a fuse as shown in FIG. 5.

Fuses 22, 24 are similar elements and, therefore, only one of the fuses will be described but the description is also applicable to the other fuse. As noted in FIGS. 3, 5 and 6, fuse 22 is a tubular or cylindrical body 26 with a first end 25 and a second end 27, and having a first end cap 28 and a second end cap 30, respectively, mounted on ends 25, 27, which end caps have larger diameters than body 26 and radially protrude from longitudinal axis 34 of body 26. As noted in the Figures, end cap 28 has a first contact blade 32 extending therefrom along blade axis 3 and generally parallel to longitudinal axis 34 of tubular body 26. A second contact blade 36 extends parallel to first or fuse body longitudinal axis 34, from second end 30 of fuse 22. In FIGS. 3, 5 and 6, blades 32, 36 are rectangularly-shaped and protrude approximately an equal length from housing end walls 40, 46, but first contact blade 32 is, in fact, shorter than second contact blade 36.

As shown in FIGS. 3, 5 and 6, fuse blades 32 and 36 on second or blade longitudinal axis 33 are coined in an offset fashion to provide the blades parallel to, but offset from, the longitudinal axis 34 of tubular body 26. In the Figures, blade 32 and end cap 28 merge in a truncated cone 70 with a first plateau or shoulder 72. Similarly, second contact blade 36 has a similar, generally truncated conical portion 74 with a second plateau or shoulder 76 at its intersection with second end 30 of fuse 22.

In a preferred embodiment, housing 12 has first end wall 40 with first blade passage 42 and second blade passage 44 therein, which blade passages are vertically elongated slits, as oriented in FIG. 1, and have a generally rectangular cross section. Similarly, second end wall 46 has third passage 48 and fourth passage 50 therein, with a similar rectangular, cross section. First sidewall 52 and second sidewall 54 of housing 12 are approximately parallel, as are end walls 40, 46; and as shown in FIG. 3, first and third passages 42, 48 are generally aligned, as are second and fourth passages 44, 50.

In FIG. 3, first sidewall 52 has a first inner surface 56 extending from second end wall 46, and a second segment or portion 58 extending into cavity 20 from first end wall 40. First and second inner surface portions 56 and 58 intersect at a first shoulder 60 in cavity 20. As shown, the wall thickness of second segment 58 is greater than the wall thickness of first segment 56. Similarly, second sidewall 54 has a first inner surface 62 and second inner surface 64 extending from first end wall 40 and second end wall 46, respectively, to intersect and provide a second shoulder 66 at their intersection. As shown in FIG. 3, the shoulders 60 and 66 are generally diagonally arranged in the approximately rectangular cavity 20 of housing 12.

First tubular fuse 22 is positioned in cavity 20 with second end cap 30 abutting first housing shoulder 60; first plateau 72 of first truncated end 70 abuts or is in proximity to second end wall inner face 45; and, contact blades 32 and 36 extend through aligned passages 48 and 42, respectively, to retain fuse 22 in position in cavity 20 against longitudinal or rotational movement. Similarly, second end cap 30 of second fuse 24 is provided generally against second shoulder 66 in cavity 20 with first plateau 72 of first truncated end 70 abutting or in proximity to first end wall inner face 43. Thus, the bodies 26 of the first and second fuses 22, 24 are generally aligned in parallel in cavity 20 and inhibited against longitudinal movement, but end caps 28, 30 of each fuse are offset to accommodate their protruding diameters, thus minimizing the space requirement within the cavity 20 and minimizing the required width of surge protector 10.

In FIG. 3, contact blade 32 of first fuse 22 extends through passage 48 and second contact blade 36 of fuse 22 extends through aligned passage 42 in first end wall 40. The first, second, third and fourth end elongated passages 42, 44, 48 and 50 with their generally rectangular cross section and extending contact blades therein, are operable to restrain or prohibit rotation of tubular fuses 22, 24 in housing 12. In this configuration, fuses 22 and 24 are secured in position in cavity 20 against movement along or rotation about fuse axes 34.

Figure 2:
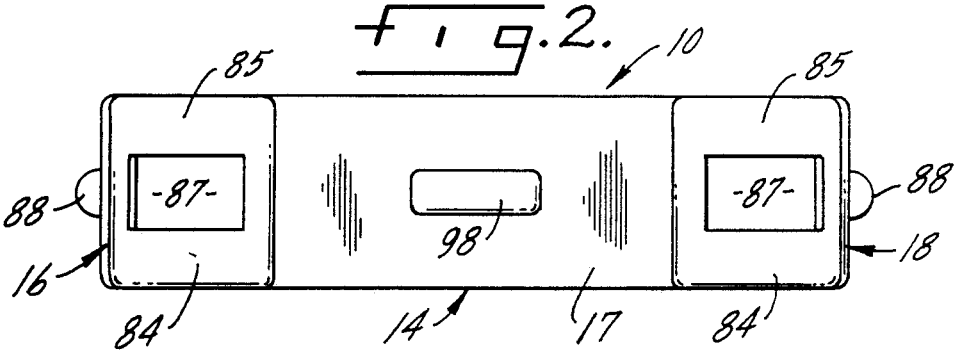
FIG. 2 is a top plan view of the fuse holder assembly of FIG. 1.
Figure 4:
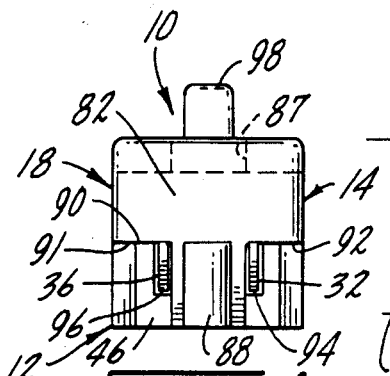
FIG. 4 is an elevational side view of the assembly in FIG. 1, taken along the line 4—4.

First and second platforms 16, 18 have a generally U-shaped profile, as shown in FIG. 1. Platforms 16, 18 are generally symmetrical and, therefore, only one platform and coupling means will be described but the description will be equally applicable to the other. As shown in FIGS. 1 and 2, first platform 16 extends from first end wall 40 and cover 14, and has a first leg 80, a second leg 82 with an end face 83. A first and second knuckle or joining base strap 84, 85 with separating gap 87 therebetween connect first and second legs 80 and 82. In FIGS. 1 and 2, leg 80 extends vertically normal from cover 14 and the straps or legs 80 and 82 are generally parallel, with a void or first gap 86 therebetween. Second leg 82 terminates at planar surface 90, as shown in FIGS. 1, 2 and 4, and has a downwardly-extending upright 88. The intersection of upright 88, which is about centrally located on surface 90, with leg 82 at surface 90 provides a first ledge 91 and a second ledge 92 on either side of this intersection. In FIGS. I and 4, contact blades 32 and 36 extend from housing 12, across gap 86 with their ends 94 and 96 resting against ledges 92, 91, respectively, and separated by upright 88. The blade ends extending from housing 12 and contacting platform 16 are similarly arranged on the ledges 91, 92.

In FIGS. 1 and 2, cover 14 has outer surface 17 and inner surface 19 With an outer edge, which inner surface 19 has a recess 21. A pair of tabs 23 extend from inner surface 19, although only one tab is noted in FIG. 1, at its outer edge, and are matable with locating bores 55, 57 in sidewalls 52, 54 (cf. FIG. 3) of housing 12 to position cover 14 on housing 12 to receive fuses 22, 24 in recess 21. Tabs 23 are preferably diagonally located on cover inner surface 19 and locating bores 55, 57 are similarly diagonally located on second segments 58, 64 of sidewalls 52, 54, which are illustrated as the thicker sidewall sections.

A gripping tab or tong 98 extends from cover assembly 14 to give the user a purchase or grip for handling and insertion of the surge protector. Cover 14 may be secured to housing 12 by means in the art, including adhesives, heat bonding, or mechanical apparatus such as screws. Housing 12 and cover 14 of surge protector 10 are an insulating material, such as plastic, and may be manufactured by rapid injection molding processes.

In the Figures, fuse-contact blades 32, 36 extend from either end of housing 12 to rest against the upright 88 and provide a contact area in gap or separation 86 at either end of surge protector 10 for insertion into a terminal or panel. This is the case for both first and second fuses 22, 24. In the configuration of housing 12 and platforms 16, 18, the fuses are retained in position against both rotation and longitudinal movement.

As seen in the Figures, first and second fuses 22, 24 are electrically isolated within the insulator housing 12, although they may be connected externally. The surge protector 10 is thus readily insertable in a circuit or on a panel board, which may have a plurality of input and output ports, to connect two circuits with fuses 22, 24. However, housing 12 insulates fuses 22, 24 from external contacts and provides the blades in a mechanically supported position against ledges 91, 92 of platforms 16, 18, which maintains the blades from deflection during insertion with the mating terminal contacts. In addition, the rectangular blades 32, 36 are restrained from rotation, and thus misalignment, in cavity 20 by the elongate passages 42, 44, 48, 50. Thus, surge protector 10 can be readily inserted into mating terminal contacts by gripping tab 98 with the knowledge that contact blades 32, 36 are aligned for insertion.

Further, the contact blades 32, 36 may be offset to reposition them along an axis for normally side-by-side mounted fuses, which accommodates the present terminal position in many known terminal blocks.

It is particularly noted in the above example that the fuse contacts are blades. The more general extending contact structure from an electrical component is a single round wire extending from each end. However, in the present invention these wire leads have been coined to provided the blade configuration in the drawings, which blade structure enhances the component stability in the carrier or housing by limiting rotation of the individual component; displaces the component centerline to allow both longitudinally and laterally offset the component within the carrier; and, does not alter the lead size in a manner to affect the resistance or electrical response of the component.

Although the above-noted preferred embodiment particularly related to a fuse holder housing, it is understood that the housing and offset component alignment are equally adaptable to other electronic components. As an example, barbell or hourglass shaped capacitors and resistors could also be secured and electrically isolated in the housing for insertion into a circuit, in a manner similar to the fuses.

While only specific embodiments of the invention have been described and shown, it is apparent that various alterations and modifications can be made therein. It is, therefore, the intention in the appended claims to cover all such modifications and alternations as may fall within the scope and spirit of the invention.

What is claimed is:

1. An electrical component carrier for cross-connecting at least two circuits, said carrier comprising:

a housing, said housing having a longitudinal axis, and defining a cavity;

a first component and a second component, each of said first and second components having a component body, a component longitudinal axis, a first contact blade and a second contact blade, said first and second contact blades extending from said housing;

a cover mounted on said housing to enclose said cavity;

said first and second components mounted in a non-contacting arrangement in said cavity, which components are offset from each other to provide said component axes parallel to said housing axis in a more narrow alignment than juxtaposed first and second components.

2. An electrical component carrier as claimed in claim 1 wherein said housing has a first end wall and a second end wall, each of said first and second end walls defining a first blade passage and a second blade passage, each of said first and second blade passages in each end wall substantially aligned with one of said first and second blade passages in the other of said end walls;

each of said components positioned in said cavity with one of said first and second blades protruding through one of a pair of said aligned end wall first and second blade passages and the other of said blade passages protruding through the other of said aligned blade passages.

3. A component carrier as claimed in claim 2 wherein said housing and said cover have a first end and a second end, said carrier further comprising a first platform, a second platform and means for coupling said platforms and said cover, one of said first and second platforms coupled to and extending from one of said first and second cover ends, and the other of said platforms coupled to and extending from the other of said cover first and second ends;

each of said first and second platforms cooperating with its associated cover and housing first and second ends to define a first gap and a second gap, respectively;

each of said first and second contact blades having a contact segment in said gap for coupling said component in said circuit and having a blade end which contacts one of said platforms.

4. An electrical carrier as claimed in claim 3 wherein each of said housing, cover and platforms are an electrically insulating material.

5. An electrical component carrier as claimed in claim 3 wherein said housing has a first sidewall and a second sidewall with an inner surface, which first and second sidewalls are approximately parallel and extend between said first and second end walls with said cavity therebetween;

said first sidewall having a first inner surface segment extending from one of said first and second end walls, and a second inner surface segment extending from the other of said first and second end walls, which first and second first-sidewall segments intersect to define a first shoulder generally facing one of said first and second end walls in said cavity;

said second sidewall having a first inner surface segment extending from the other of said first and second end walls, and a second inner surface segment extending from the one of said first and second sidewalls, which first and second second-sidewall segments intersect to define a second shoulder in said cavity generally facing the other of said first and second end walls from said first shoulder;

each of said first and second electrical components having a first end and a second end, and nested between one of said first and second shoulders and said facing one of said end walls with each of said component first and second blades extending through an aligned blade passage in the first and second end walls.

6. An electrical component carrier as claimed in claim 5 wherein each of said first and second electrical components has a cylindrical body with a centerline along said component longitudinal axis;

said contact blades of each of said first and second components being approximately parallel to said respective component longitudinal axis and offset from said component body centerline;

said contact blades extending through one of said aligned first passages and second passages with said blade ends positioned on said respective platforms.

7. An electrical component carrier as claimed in claim 5 wherein each of said component contact blades has a generally rectangular-shaped cross section;

said first and second end wall passages have a rectangular-shaped cross section and are vertically extending to receive said blades, which maintains said blades and component bodies along said respective sidewall inner surface in said cavity and prohibits rotation and intercomponent contact of said first and second components in said carrier.

8. An electrical component carrier as claimed in claim 3 wherein coupling means for each of said first and second platforms is a U-shaped strap member with an inner arm, an outer arm and a connecting base coupling said arms;

each of said outer arms having a terminus at a platform;

an upright member mounted on each of said outer arm platforms and protruding generally normal thereto, which upright member and platform cooperate to define a first ledge and a second ledge on each platform;

one of said contact blade ends resting on each of said first and second platform ledges with said upright member therebetween to maintain said contact blades in position.

9. An electrical component carrier as claimed in claim 5 wherein said cover has an outer surface and an inner surface, which cover has a recess to receive a component surface extending from said cavity; and, a tab, said tab mounted and extending normally from said cover outer surface and operable as a gripping member for said component carrier.

10. An electrical component carrier as claimed in claim 5 further comprising means for securing;

said cover mounted on said housing and secured thereto at said first and second end walls and sidewalls by said securing means.

11. An electrical component carrier as claimed in claim 10 wherein said securing means is an adhesive.

12. An electrical component carrier as claimed in claim 10 wherein said securing means is fusion bonding.

13. An electrical component carrier as claimed in claim 6, wherein said cylindrical component body has a diameter, a first end and a second end, said component further comprising a first component end cap and a second component end cap, one of said first and second end caps mounted on one of said cylindrical component body first and second ends and the other of said first and second end caps mounted on the other of said first and second component body ends of each of said components;

each of said end caps having an outer surface and a diameter greater than the cylindrical body diameter;

said electrical components positioned with said component bodies in parallel in said cavity and said component end cap outer surfaces substantially aligned along said housing centerline in a staggered arrangement between housing end walls.

14. An electrical component carrier as claimed in claim 13 wherein said first and second contact blades extend from said first and second end caps, respectively;

each of said first and second contact blades offset at the intersection of said blade and end cap to form a first and second end cap seat, respectively;

one of said first and second seats of each component in immediate proximity to said end wall to maintain the component in position in said cavity.

15. An electrical component carrier as claimed in claim 14 wherein one of said first and second contact blades has a first blade length and the other of said contact blades has a second blade length and one of said first and second blade lengths is longer than the other of said blade lengths;

a contact blade from each of said first and second components extending through each of said first and second end walls, said contact blades arranged in said housing cavity with the first and a second contact blade from the aligned components projecting from each of said end walls with the blade end of each blade equidistant from said associated housing end wall.

16. An electrical component carrier as claimed in claim 1, which component has a dumbbell shape.

17. An electrical component carrier as claimed in claim 16, which electrical component is a resistor.

18. An electrical component carrier as claimed in claim 16, which electrical component is a diode.

19. An electrical component carrier as claimed in claim 16, which electrical component is a capacitor.

20. An electrical component carrier as claimed in claim 16, which electrical component is a fuse.

21. A fuse carrier for cross-connecting at least two circuits and operable as a surge current protector, said carrier comprising:

a housing, said housing having a longitudinal axis, and defining a cavity;

a first fuse and a second fuse, each of said first and second fuses having a fuse body, a fuse longitudinal axis, a first contact blade and a second contact blade, said first and second contact blades extending from said housing;

a cover mounted on said housing to enclose said cavity;

said first and second fuses mounted in a noncontacting arrangement in said cavity, which fuses are offset from each other to provide said fuse axes parallel to said housing axis in a more narrow alignment than juxtaposed first and second fuses.

22. A fuse carrier as claimed in claim 21 wherein said housing has a first end wall and a second end wall, each of said first and second end walls defining a first blade passage and a second blade passage, each of said first and second blade passages in each end wall substantially aligned with one of said first and second blade passages in the other of said end walls;

each of said fuses positioned in said cavity with one of said first and second blades protruding through one of a pair of said aligned end wall first and second blade passages and the other of said blade passages protruding through the other of said aligned blade passages.

23. A fuse carrier as claimed in claim 22 wherein said housing and said cover have a first end and a second end, said carrier further comprising a first platform, a second platform and means for coupling said platforms and said cover, one of said first and second platforms coupled to and extending from one of said first and second cover ends, and the other of said platforms coupled to and extending from the other of said cover first and second ends;

each of said first and second platforms cooperating with its associated cover and housing first and second ends to define a first gap and a second gap, respectively;

each of said first and second contact blades having a contact segment in said gap for coupling said fuse in said circuit and having a blade end which contacts one of said platforms.

24. A fuse carrier as claimed in claim 23 wherein each of said housing, cover and platforms are an electrically insulating material.

25. A fuse carrier as claimed in claim 23 wherein said housing has a first sidewall and a second sidewall with an inner surface, which first and second sidewalls are approximately parallel and extend between said first and second end walls with said cavity therebetween;

said first sidewall having a first inner surface segment extending from one of said first and second end walls, and a second inner surface segment extending from the other of said first and second end walls, which first and second first-sidewall segments intersect to define a first shoulder generally facing one of said first and second end walls in said cavity;

said second sidewall having a first inner surface segment extending from the other of said first and second end walls, and a second inner surface segment extending from the one of said first and second sidewalls, which first and second second-sidewall segments intersect to define a second shoulder in said cavity generally facing the other of said first and second end walls from said first shoulder;

each of said first and second fuses having a first end and a second end, and nested between one of said first and second shoulders and said facing one of said end walls with each of said fuse first and second blades extending through an aligned blade passage in the first and second end walls.

26. A fuse carrier as claimed in claim 25 wherein each of said first and second fuses has a cylindrical body with a centerline along said fuse longitudinal axis;

said contact blades of each of said first and second fuses being approximately parallel to said respective fuse longitudinal axis and offset from said fuse body centerline;

said contact blades extending through one of said aligned first passages and second passages with said blade ends positioned on said respective platforms.

27. A fuse carrier as claimed in claim 25 wherein each of said fuse contact blades has a generally rectangular-shaped cross section;

said first and second end wall passages have a rectangular-shaped cross section and are vertically extending to receive said blades, which maintains said blades and fuse bodies along said respective sidewall inner surface in said cavity and prohibits rotation and interfuse contact of said first and second fuses in said carrier.

28. A fuse carrier as claimed in claim 23 wherein coupling means for each of said first and second platforms is a U-shaped strap member with an inner arm, an outer arm and a connecting base coupling said arms;

each of said outer arms having a terminus at a platform;

an upright member mounted on each of said outer arm platforms and protruding generally normal thereto, which upright member and platform cooperate to define a first ledge and a second ledge on each platform;

one of said contact blade ends resting on each of said first and second platform ledges with said upright member therebetween to maintain said contact blades in position.

29. A fuse carrier as claimed in claim 25 wherein said cover has an outer surface and an inner surface, which cover has a recess to receive a fuse surface extending from said cavity; and, a tab, said tab mounted and extending normally from said said cover outer surface and operable as a gripping member for said fuse carrier.

30. A fuse carrier as claimed in claim 25 further comprising means for securing;

said cover mounted on said housing and secured thereto at said first and second end walls and sidewalls by said securing means.

31. A fuse carrier as claimed in claim 30 wherein said securing means is an adhesive.

32. A fuse carrier as claimed in claim 30 wherein said securing means is fusion bonding.

33. A fuse carrier as claimed in claim 26, wherein said cylindrical fuse body has a diameter, a first end and a second end, said fuse further comprising a first fuse end cap and a second fuse end cap, one of said first and second end caps mounted on one of said cylindrical fuse body first and second ends and the other of said first and second end caps mounted on the other of said first and second fuse ends of each fuse;

each of said end caps having an outer surface and a diameter greater than the cylindrical body diameter;

said fuses positioned with said fuse bodies in parallel in said cavity and said fuse end cap outer surfaces substantially aligned along said housing centerline in a staggered arrangement between housing end walls.

34. A fuse carrier as claimed in claim 33 wherein said first and second contact blades extend from said first and second end caps, respectively;

each of said first and second contact blades offset at the intersection of said blade and end cap to form a first and second end cap seat, respectively;

one of said first and second seats of each fuse in immediate proximity to said end wall to maintain the fuse in position in said cavity.

35. A fuse carrier as claimed in claim 34 wherein one of said first and second contact blades has a first blade length and the other of said contact blades has a second blade length and one of said first and second blade lengths is longer than the other of said blade lengths;

a contact blade from each of said first and second fuses extending through each of said first and second end walls, said contact blades arranged in said housing cavity with the first and a second contact blade from the aligned fuses projecting from each of said end walls with the blade end of each blade equidistant from said associated housing end wall.

36. A fuse carrier for cross-connecting at least two circuits and operable as a surge-current protector, said carrier comprising:

a housing, which housing defines a cavity;

a first fuse and a second fuse, each of said first and second fuses having a fuse body, a fuse longitudinal axis, a first contact blade with a first blade end and a second contact blade with a second blade end, which contact blades are approximately aligned and have a blade longitudinal axis parallel to and displaced from said fuse longitudinal axis;

said housing having a first end and a second end, a first end wall and a second end wall at said respective housing ends, which end walls are approximately parallel;

said housing having a first sidewall and a second sidewall, which sidewalls connect said end walls and are approximately parallel, one of said first and second sidewalls having a first inner segment extending from one of said first and second end walls, and a second inner segment extending from the other of said first and second end walls and intersecting with said first inner segment to define a first shoulder at said intersection;

the other of said first and second sidewalls having a first inner segment extending from the other of said first and second end walls and a second inner segment extending from the one of said first and second end walls to intersect with said first inner segment to define a second shoulder at said intersection;

a cover with a recess;

a first platform and a second platform;

means for coupling said first platform and said second platform to said cover;

said cover mounted on said housing with one of said first and second platforms extending from one of said housing first and second ends, and the other of said first and second platforms extending from the other of said housing first and second ends, said cover positioned to receive said first and second fuse bodies protruding from said cavity;

said first and second contact blades of each of said fuses equidistantly projecting through one and the other of said first and second end walls with a contact blade end from each of said first and second fuses nesting on the associated first and second platforms secured to said cover at said first and second housing end; and, a first protuberance and a second protuberance normally extending from said first and second platforms, respectively, and positioned between said contact blades nested on said platform.

37. A fuse carrier as claimed in claim 36 wherein said cover has an outer surface;

a gripping tab normally mounted on said cover outer surface to provide a purchase for positioning said fuse carrier in a circuit.

38. A fuse carrier as claimed in claim 36 wherein each of said platforms and housing ends define a gap therebetween;

a terminal block with a first and a second terminal position;

said contact blades extending from said ends having a contact surface projecting across said gap to said platform for mating with a terminal position, which first and second fuses are each coupled between a first and a second terminal position to connect a circuit.

39. An assembly for retaining electrical components, which have at least one enlarged end portion, said assembly operable to secure and insulate said components for ready insertion into a circuit, said assembly comprising a housing having a longitudinal axis and defining a cavity;

a first end wall and a second end wall;

a first sidewall and a second sidewall;

said first sidewall having a first shoulder extending into said cavity and facing one of said first end walls and second end walls;

said second sidewall having a second shoulder extending into said cavity and facing the other of said first and second end walls;

a cover mounted on said housing to enclose said cavity;

a first electrical component and a second electronic component, each of said components having a longitudinal axis, a first contact blade and a second contact blade;

one of said first and second electronic components positionable in said cavity in a noncontacting arrangement between one of said first and second shoulders and said facing end wall, and the other of said first and second components positioned between the other of said first and second shoulders and end walls, said housing maintaining said electronic components offset and noncontacting from each other with said component axes parallel to said housing axis in a more narrow alignment than juxtaposed first and second components.

40. An assembly as claimed in claim 39 wherein each of said first and second housing end walls defines a first blade passage and a second blade passage, one of said first and second blade passages in the first housing end wall substantially aligned with one of said first and second blade passages in said second housing end wall, and the other of said first housing end wall blade passages substantially aligned with the other of said second housing end wall blade passages;

said first and second contact blades of one of said electrical components extending through one aligned pair of said blade passages in opposed first and second end walls and the other of said electrical components first and second contact blades extending through the other of said aligned pair of blade passages to position and maintain said components stable in said cavity.

41. An assembly as claimed in claim 40 wherein each of said components has a first end and a second end, at least one of said ends having an enlarged portion;

one of said first and second ends of each component nested against one of said first and second housing end walls and the other of said first and second component ends nested against said shoulder facing said component end-contacting housing end wall and, the other of said components having one of its first and second ends contacting the other of said first and second end walls and the other of its first and second housing ends contacting the shoulder facing said other housing end wall to maintain said electronic components in longitudinal position in said cavity.

42. An assembly as claimed in claim 41 wherein said cover has a first cover end and a second cover end, said assembly further comprising a first platform, a second platform and means for coupling said platforms and said cover, one of said first and second platforms coupled to and extending from one of said first and second cover ends by said coupling means and the other of said platforms coupled to and extending from the other of said first and second cover ends by said coupling means;

each of said first and second platforms cooperating with its associated cover, first and second housing ends to define a first gap and a second gap, respectively;

each of said first and second contact blades having a blade end and a contact segment extending through said gap for coupling said component in a circuit, which blade end rests on one of said platforms.

43. An assembly as claimed in claim 42 wherein said coupling means for each of said first and second platforms is a U-shaped strap member with an inner arm and an outer arm and a connecting base coupling said arms;

each of said outer arms having a terminus at a platform;

an upright member mounted on each of said outer arm platforms and protruding generally normally thereto, which upright member and platform cooperate to define a first ledge and a second ledge on each platform;

one of said contact blade ends resting on each of said first and second platform ledges with said upright member therebetween to maintain said contact blades in position.

44. An assembly as claimed in claim 39, which housing, cover and platforms are an electrically insulating material.

45. An assembly as claimed in claim 44 further comprising a means for securing; said cover mounted on said housing and secured thereto at said first and second housing end walls and sidewalls by said securing means.

46. An assembly as claimed in claim 45 wherein said securing means is an adhesive.

47. An assembly as claimed in claim 45 wherein said securing means is fusion bonding.

48. An assembly as claimed in claim 39 wherein said cover has an outer surface, an inner surface, and a recess on said inner surface to receive an electrical component surface extending from said cavity;

said cover comprising a tab, said tab mounted on and extending normally from said cover outer surface, which tab is operable as a gripping member for said assembly.

49. An assembly as claimed in claim 48 further comprising at least one alignment plug extending from said cover inner surface;

said housing defining at least one port, in at least one of said end walls and sidewalls for mating with said cover plug to align and secure said cover and housing.

* * * * *